US005448249A

United States Patent [19]

Kushihi et al.

[11] Patent Number: 5,448,249

[45] Date of Patent: Sep. 5, 1995

[54] ANTENNA DEVICE

[75] Inventors: Yuichi Kushihi; Yoshiyuki Sonoda, both of Nagaokakyo, Japan

[73] Assignee: Murata Manufacturing Co., Ltd., Nagaokakyo, Japan

[21] Appl. No.: 23,629

[22] Filed: Feb. 26, 1993

[30] Foreign Application Priority Data

Feb. 27, 1992 [JP] Japan ..... 4-018913 U

[51] Int. Cl.[6] ..... H01Q 1/38; H01Q 23/00

[52] U.S. Cl. ..... 343/700 MS; 343/846

[58] Field of Search ..... 343/700 MS, 853, 769, 343/846; H01Q 1/38, 23/00, 13/08

[56] References Cited

U.S. PATENT DOCUMENTS

| | | | |
|---|---|---|---|
| 3,710,337 | 1/1973 | Grant | 343/701 |
| 4,208,660 | 6/1980 | McOwen, Jr. . | |
| 4,218,682 | 8/1980 | Yu . | |
| 4,401,988 | 8/1983 | Kaloi . | |
| 4,823,136 | 4/1989 | Nathanson et al. . | |
| 4,987,425 | 1/1991 | Zahn et al. | 343/700 MS |
| 5,019,829 | 5/1991 | Heckman et al. . | |
| 5,023,624 | 6/1991 | Heckaman et al. | 343/700 MS |
| 5,030,961 | 7/1991 | Tsao | 343/700 MS |
| 5,083,132 | 1/1992 | Kanda et al. . | |
| 5,142,698 | 8/1992 | Koga et al. | 343/700 MS |
| 5,210,542 | 5/1993 | Pett et al. | 343/700 MS |
| 5,309,163 | 5/1994 | Ngan et al. | 343/700 MS |

FOREIGN PATENT DOCUMENTS 262703 10/1990 Japan ..... 343/700 MS

OTHER PUBLICATIONS

JP 2-244 803A Patents Abstract of Japan, Sect. E, vol. 14 (1990), No. 564 (E-1013).

JP 1-18 207A Patents Abstract of Japan, Sect. E., vol. 13 (1989), No. 481 (E-838).

JP 63-316 905A Patents Abstract of Japan, Sect. E., vol. 13 (1989), No. 164 (E-745).

JP 63-61 501A Patents Abstract of Japan, Sect. E., vol. 12 (1988), No. 285 (E-642).

*Primary Examiner*—Michael C. Wimer

*Attorney, Agent, or Firm*—Armstrong, Westerman, Hattori, McLeland & Naughton

[57] ABSTRACT

In an antenna device according to the present invention, a circular ring-shaped dielectric substrate has a radiation electrode formed on its one main surface and a ground electrode formed on its other main surface. In a vacant space portion of the dielectric substrate, a circular convex portion of a first base member is fitted, with an electronic circuit being fixed in the circular convex portion. The radiation electrode and the electronic circuit are connected to each other by a feeder line. Since the electronic circuit connected with the microstrip antenna is accommodated within the vacant space portion of the dielectric substrate, a compact and thin antenna device may be obtained.

14 Claims, 11 Drawing Sheets

ANTENNA DEVICE

BACKGROUND OF THE INVENTION

1. Field of the Invention

The present invention generally relates to an antenna device, and more particularly, to an improvement of a microstrip antenna incorporated with an electronic circuit.

2. Description of the Related Art

Conventionally, there has been known a microstrip antenna in which an electronic circuit such as an amplifier, filter or the like is incorporated (referred to as an antenna device hereinafter).

In a known antenna device as shown in FIGS. 19 and 20 (referred to as a first prior art hereinafter), a microstrip antenna and an electronic circuit to be connected therewith are piled one upon another in a vertical direction.

More specifically, the antenna device of the first prior art in FIGS. 19 and 20 generally includes a dielectric substrate 1 in a circular flat plate-like configuration, a circular radiation electrode 2 formed at a central portion on one main surface of said dielectric substrate 1, a circular ground electrode 3 formed on an entire face of the other main surface of said dielectric substrate 1, and a feeder line 4 connected at its one end 4*a* to said radiation electrode 2 for supplying power thereto, and provided in a position somewhat deviated in a direction of diameter from a center of the radiation electrode 2.

In the above arrangement, the so-called microstrip antenna is constituted by the dielectric substrate 1, radiation electrode 2, ground electrode 3, and feeder line 4. This microstrip antenna is fixedly placed on a base 5 made, for example, of a metallic conductor. On an under surface of the base 5, an electronic circuit 6 having an amplifier, filter or the like is fixedly mounted. The electronic circuit 6 generally includes an insulative circuit substrate 6*a*, a ground electrode 6*b* formed on one main surface of the circuit substrate 6*a*, a circuit pattern 6*c* and electronic parts (capacitor, resistor, etc.) 6*d* formed on the other main surface thereof.

The feeder line 4 referred to earlier extends through the radiation electrode 2, dielectric substrate 1, ground electrode 3, base 5, ground electrode 6*b*, and circuit substrate 6*a*, with the other end 4*b* thereof being connected to the circuit pattern 6*c* formed on the other main surface of the circuit substrate 6*a*. In other words, power is given to the feeder line 4 through the circuit pattern 6*a*.

Moreover, on the under surface of the base 5, a cap member 7 is provided for protecting the electronic circuit 6, and preventing electromagnetic wave noises.

In another example of conventional antenna devices as shown in FIGS. 21 and 22 (referred to as a second prior art hereinafter), the microstrip antenna and the electronic circuit connected thereto are aligned laterally on the same dielectric substrate.

More specifically, as shown in FIGS. 21 and 22, on one main surface of a dielectric substrate 11 in a rectangular flat plate-like shape, a circular radiation electrode 21 is formed at a central portion in the left half portion thereof, while an electronic circuit 61 is constituted at a central portion in its right half portion as shown, with the radiation electrode 21 and the electronic circuit 61 being connected to each other by a feeder line 41. Moreover, on the other main surface of the dielectric substrate 11, a ground electrode 31 is formed on its entire surface.

In the antenna device of the first prior art as described earlier, since the microstrip antenna and the electronic circuit 6 are piled up vertically one upon another, the antenna device tends to be higher on the whole, and thus, the advantage of the microstrip antenna which is thin is undesirably lost.

On the other hand, in the antenna device of the second prior art technique also referred to above, although the arrangement may be formed to be thin, since the microstrip antenna and the electronic circuit 61 are disposed on the same plane, there is involved another problem that the planner shape tends to be large.

SUMMARY OF THE INVENTION

Accordingly, an essential object of the present invention is to provide a compact antenna device of a thin type, with a substantial elimination of the disadvantages inherent in the conventional antenna devices of this kind.

Another object of the present invention is to provide an antenna device of the above described type, which is simple in construction and stable in functioning with high reliability, and which can be readily manufactured at low cost.

In accomplishing these and other objects, according to one preferred embodiment of the present invention, there is provided an antenna device which includes a microstrip antenna and an electronic circuit connected to said microstrip antenna.

The microstrip antenna comprises a dielectric substrate having first and second main surfaces, an outer peripheral face and an inner peripheral face, and is formed with a vacant space portion, defined by said inner peripheral face at a central portion of said dielectric substrate, a radiation electrode formed on said first main surface of said dielectric substrate so as to extend over at lest said vacant space portion, a ground electrode formed at least on the second main surface of said dielectric substrate, and a feeder line for connecting said electrode and said electronic circuit. The electronic circuit is disposed within said vacant space portion of said dielectric substrate.

In the above arrangement of the present invention, by accommodating the electronic circuit connected to the microstrip antenna in the vacant space disposed at the central portion of the dielectric substrate, it is intended to reduce the size and thickness of the antenna device.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
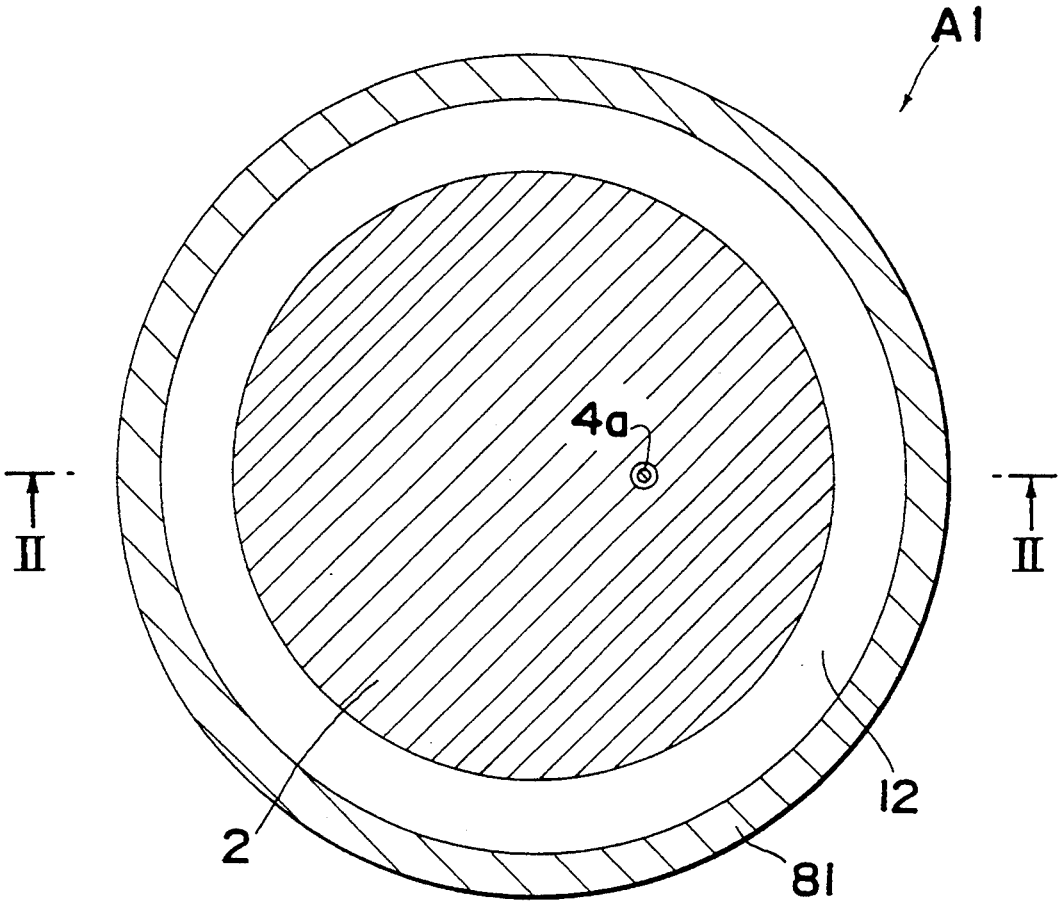
FIG. 1 is a top plan view showing construction of an antenna device A1 according to a first embodiment of the present invention.

Before the description of the present invention proceeds, it is to be noted that like parts are designated by like reference numerals throughout the accompanying drawings.

(1) First Embodiment

Figure 2:
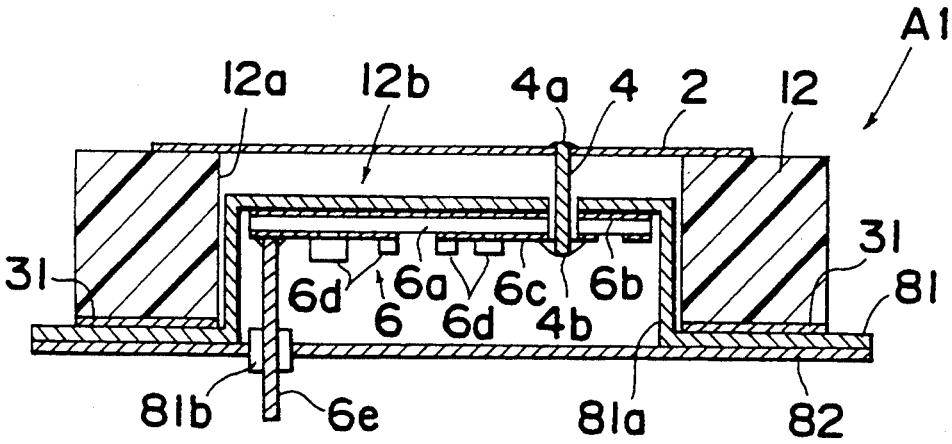
FIG. 2 is a cross sectional view taken along the line II—II in FIG. 1.

Referring now to the drawings, there is shown in FIGS. 1 and 2, an antenna device A1 according to a first embodiment of the present invention which includes a microstrip antenna and an electronic circuit 6 connected to said microstrip antenna. The microstrip antenna comprises a dielectric substrate 12 having first and second main surfaces, an outer peripheral face and an inner peripheral face, and formed with a vacant space portion defined by said inner peripheral face at a central portion of said dielectric substrate 12, a radiation electrode 2 formed on the first main surface of said dielectric substrate 12 so as to cover or extend over at least the vacant space portion 12*b*, a ground electrode 31 formed at least on the second main surface of said dielectric substrate 12, and a feeder line 4 for connecting said electrode 2 and said electronic circuit 6. The electronic circuit 6 is disposed within said vacant space portion 12*b* of said dielectric substrate 12.

More specifically, as shown in FIGS. 1 and 2, on one main surface of the circular ring-shaped dielectric substrate 12, the circular radiation electrode 2 is formed at a central portion of said substrate 12, and the diameter of this radiation electrode 2 is selected to be of a value larger than an inner diameter of said dielectric substrate 12. Accordingly, the radiation electrode 2 covers the entire circular opening at the one main surface of the dielectric substrate 12, and also, contacts, at part of its under surface, said one main surface of the dielectric substrate 12 (FIG. 2). The other main surface of said dielectric substrate 12 is entirely formed with the ground electrode 31 having the circular ring-like shape similar to the other main surface of the substrate 12. Moreover, one end 4*a* of the feeder line 4 for supplying power to the radiation electrode 2 is connected to the radiation electrode 2. The feeder line 4 is provided in a position slightly deviated from a center of the radiation electrode 2 in a direction of diameter.

Figure 19:
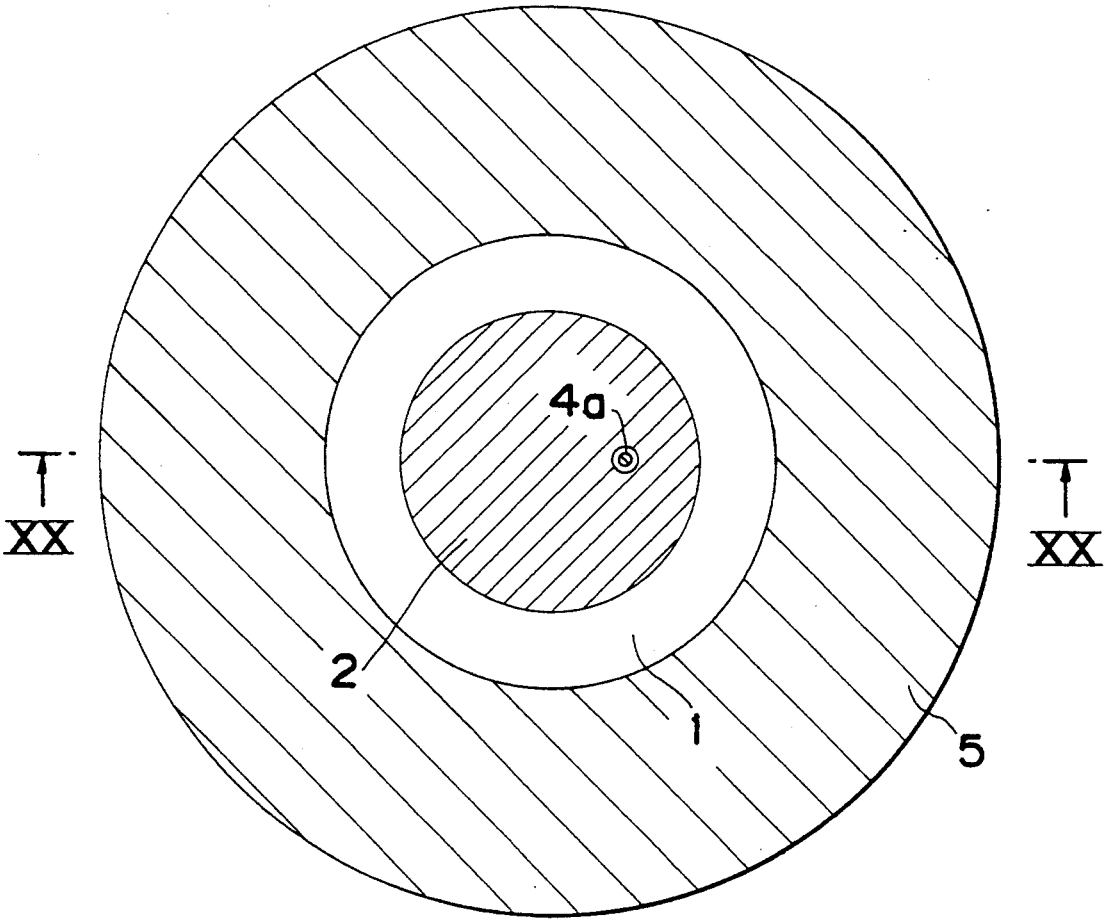
Fig.19 PRIOR ART
FIG. 19 is a top plan view showing construction of a conventional antenna device of a first prior art (already referred to)
Figure 20:
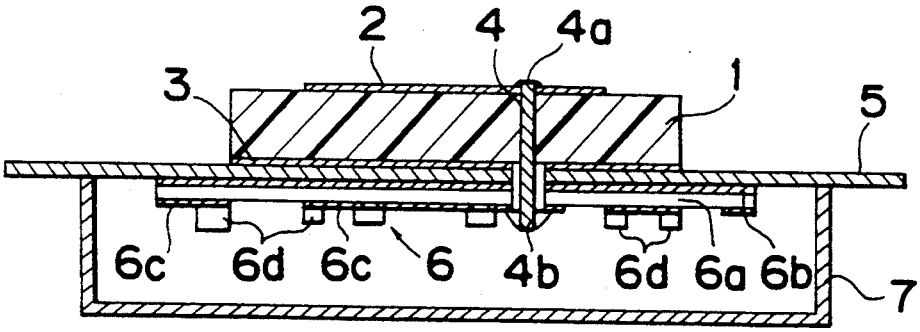
Fig.20 PRIOR ART
FIG. 20 is a cross sectional view taken along the line XX—XX in FIG. 19.
Figure 21:
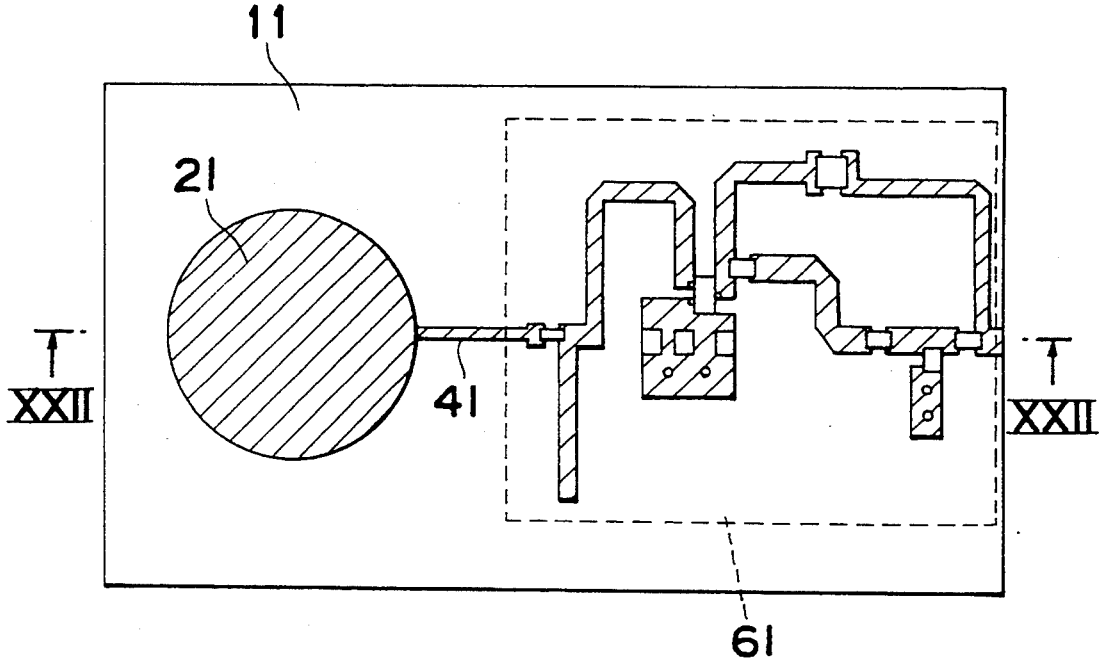
Fig.21 PRIOR ART
FIG. 21 is a top plan view showing construction of a conventional antenna device of a second prior art (already referred to)
Figure 22:
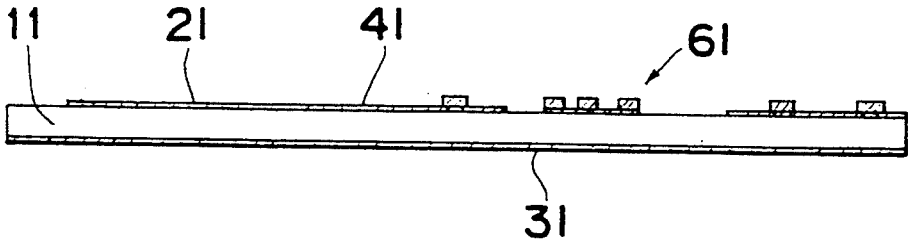
Fig.22 PRIOR ART
FIG. 22 is a cross sectional view taken along the line XXII—XXII in FIG. 1.

The microstrip antenna is constituted by the radiation electrode 2, dielectric substrate 12, ground electrode 31, and feeder line 4, and is fixedly placed on a circular first base member 81. At a central portion of said first base member 81, a hollow circular convex portion 81*a* is formed. This circular convex portion 81*a* is fitted in the vacant space 12*b* defined by the inner peripheral face 12*a* of the dielectric substrate 12. On the under surface of the first base member 81 and at a ceiling portion of the circular convex portion 81*a*, the electronic circuit 6 is fixedly provided. Similar to the electronic circuit referred to earlier with reference to the first prior art in FIGS. 19 and 20, this electronic circuit 6 includes the insulative circuit substrate 6*a*, the ground electrode 6*b* formed on one main surface of the circuit substrate 6*a*, the circuit pattern 6*c* formed on the other main surface of said circuit substrate 6*a*, and the electronic parts 6*d* (including capacitors, resistors, etc.). Moreover, to the circuit pattern 6*c*, one end of an input/output terminal 6*e* extending downwardly is connected. The electronic circuit 6 is connected to outer circuits (not shown) through said input/output terminal 6*e*.

The feeder line 4 extends through the radiation electrode 2, the first base member 81, the ground electrode 6*b* and the circuit substrate 6*a*, and is connected, at its other end 4*b*, to the circuit pattern 6*c* formed on the other main surface of the circuit substrate 6*a*. Namely, the microstrip antenna is connected to the electronic circuit 6 through the feeder line 4, whereby power for transmission is supplied from the electronic circuit 6 to the microstrip antenna, and the signal received by the microstrip antenna is given to the electronic circuit 6. It is to be noted here that the diameters of holes formed in the first base member 81, ground electrode 6*b* and circuit substrate 6*a* for extending the feeder line 4 therethrough respectively are set to be larger than the diameter in the cross section of the feeder line 4. Accordingly, the feeder line 4 does not contact the first base member 81, and the ground electrode 6*b* for electrical insulation therefrom.

Furthermore, to the under surface of the first base member 81, a second base member 82 is fixed for protection of the electronic circuit 6, and also for prevention of electromagnetic wave noises. Additionally, on the second base member 82, a porcelain insulator 81*b* is provided for leading the input/output terminal 6*e* outside in an insulated state.

As described so far, according to the first embodiment of the present invention, since the electronic circuit 6 is accommodated in the vacant space 12*b* provided at the central portion of the dielectric substrate 12, the thickness and flat face configuration of the entire antenna device becomes generally equal to those of the dielectric substrate 12, and thus, a compact and thin type antenna device may be advantageously obtained.

(2) Second Embodiment

Figure 3:
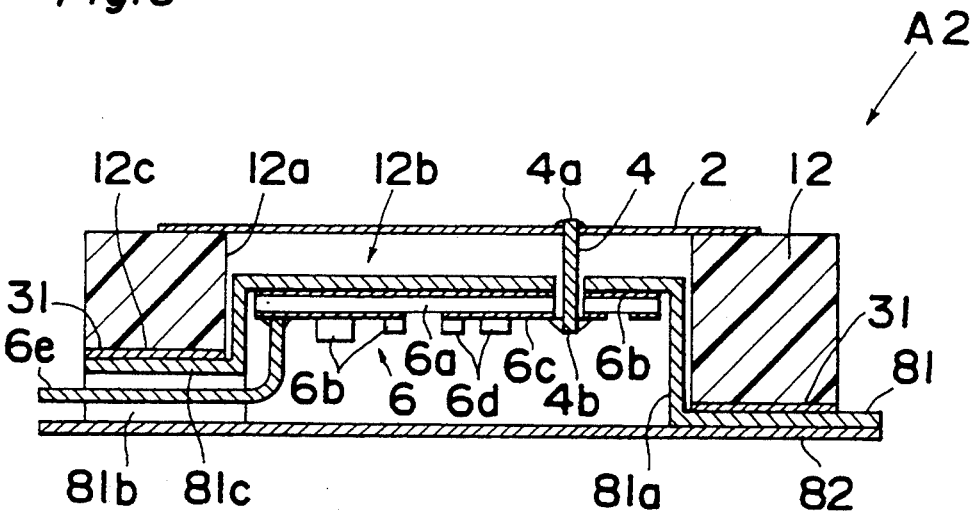
FIG. 3 is a side sectional view showing construction of an antenna device A2 according to a second embodiment of the present invention.

FIG. 3 shows an antenna device A2 according to a second embodiment of the present invention, in which the input/output terminal 6*e* described as extended downwardly in the first embodiment of FIGS. 1 and 2 is modified to be led out laterally as illustrated. More specifically, at the other main surface side of the dielectric substrate 12, a concave groove 12*c* for leading out the input/output terminal 6*e* is formed to extend in a radial direction, with a hollow convex groove 81*c* which fits in said concave groove 12*c* being formed in the first base member 81. The input/output terminal 6*e* is drawn outside through the porcelain insulator 81*b* provided within the convex groove 81*c*. In other words, the input/output terminal 6*e* is led outside in a state where it is insulated from the first and second base members 81 and 82.

Since other constructions and functions of the antenna device A2 for the second embodiment as described above are generally similar to those of the antenna device A1 for the first embodiment described earlier with reference to FIGS. 1 and 2, detailed descriptions thereof have been abbreviated here for brevity of explanation, with like parts being designated by like reference numerals.

(3) Third Embodiment

Figure 4:
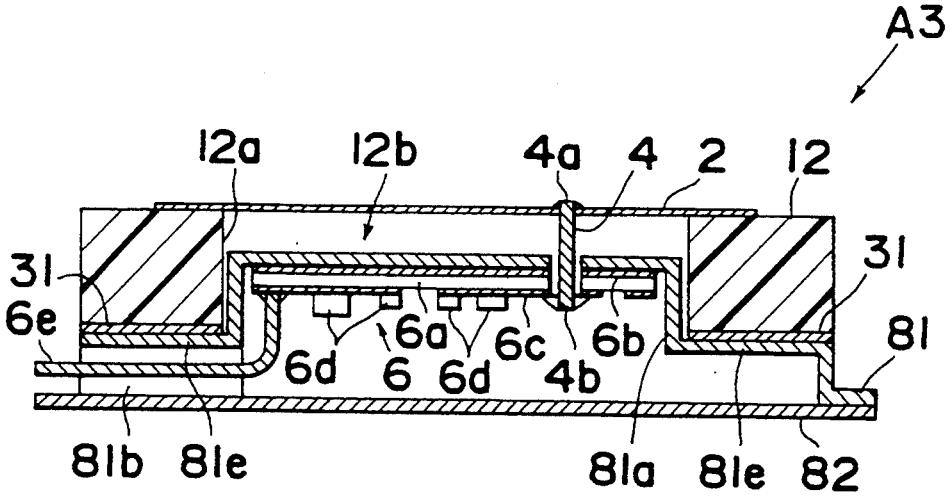
FIG. 4 is a side sectional view showing construction of an antenna device A3 according to a third embodiment of the present invention.

Referring further to FIG. 4, there is shown an antenna device A3 according to a third embodiment of the present invention, in which the dielectric substrate 12 is formed to have a uniform thickness, and the concave groove 12*c* described as provided in the antenna device A2 of FIG. 3 is dispensed with. Meanwhile, in the first base member 81, a stepped portion 81*e* is formed at a position confronting the other main surface of the dielectric substrate 12, and the input/output terminal 6*e* is led out of the device extending through the porcelain insulator 81*b* provided in said stepped portion 81*e*.

Since other constructions and functions of the antenna device A3 of the third embodiment as described above are generally similar to those of the antenna device A1 for the first embodiment described earlier with reference to FIGS. 1 and 2, detailed description thereof has been abbreviated here for brevity of explanation, with like parts being designated by like reference numerals.

(4) Fourth Embodiment

Figure 5:
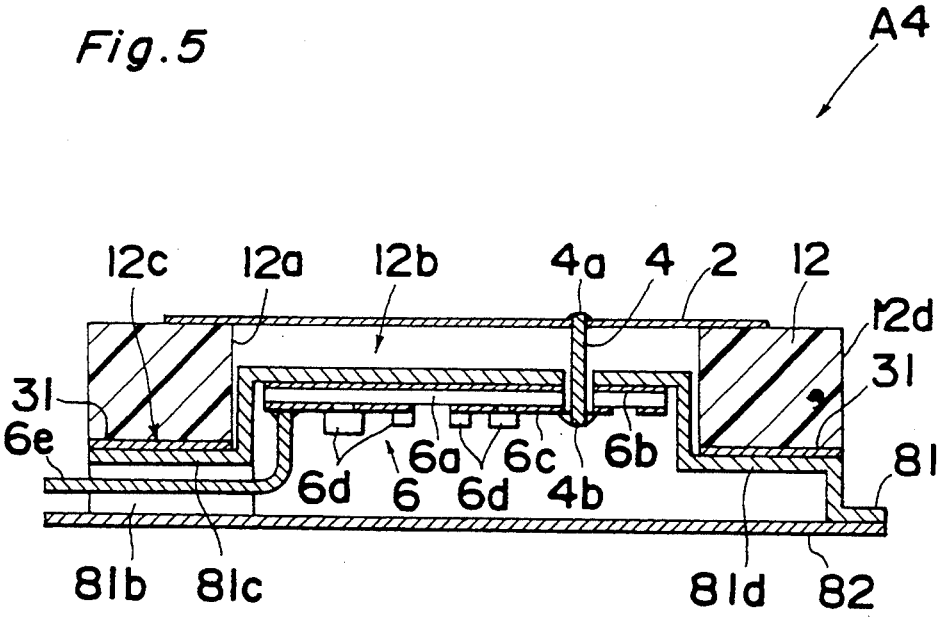
FIG. 5 is a side sectional view showing construction of an antenna device A4 according to a fourth embodiment of the present invention.
Figure 6:
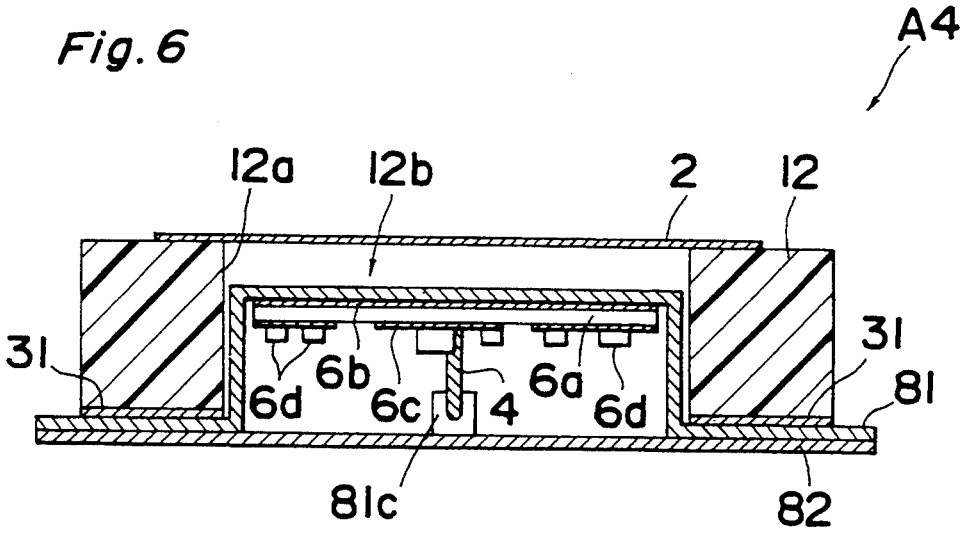
FIG. 6 is also a side sectional view showing the construction of the antenna device A4 according to the fourth embodiment of the present invention, which is particularly taken in a direction intersecting at right angles with that of FIG. 5.

FIGS. 5 and 6 show an antenna device A4 according to a fourth embodiment of the present invention, respectively representing the cross sections of said antenna device taken along directions intersecting at right angles to each other.

In the fourth embodiment of FIGS. 5 and 6, two concave grooves 12*c* and 12*d* are formed in positions confronting through 180° in the under surface of the dielectric substrate 12, while in the first base member 81, corresponding two hollow convex grooves 81*c* and 81*d*, which are fitted with said concave grooves 12*c* and 12*d*, are formed in said first base member 81. The input/output terminal 6*e* is drawn out of the device through the porcelain insulator 81*b* provided in the convex groove 81*c*.

Since other constructions and functions of the antenna device A4 for the fourth embodiment as described above are generally similar to those of the antenna device A2 for the second embodiment described earlier with reference to FIG. 3, detailed description thereof has been abbreviated here for brevity of explanation, with like parts being designated by like reference numerals.

(5) Fifth Embodiment

Figure 7:
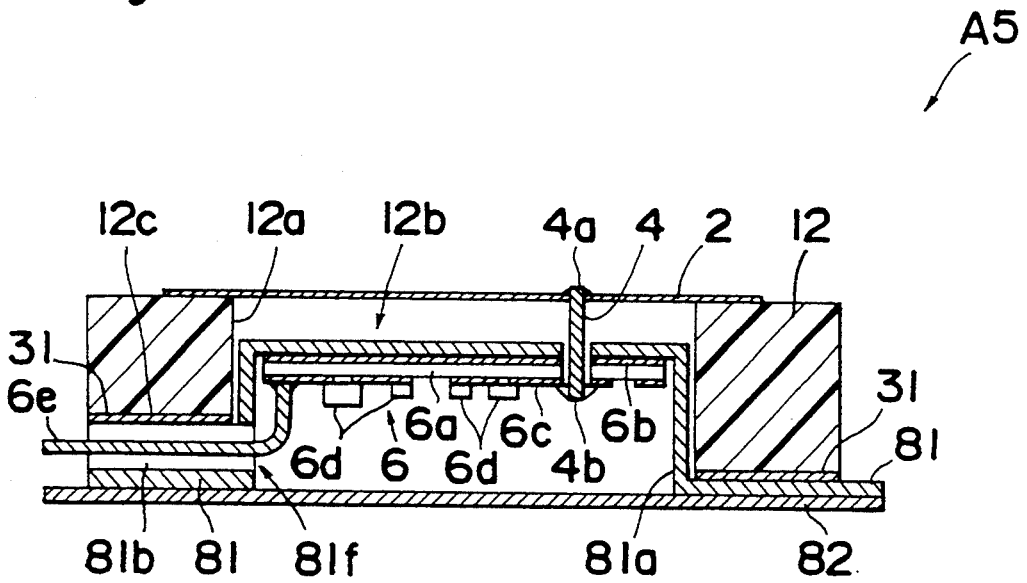
FIG. 7 is a side sectional view showing construction of an antenna device A5 according to a fifth embodiment of the present invention.

FIG. 7 shows an antenna device A5 according to a fifth embodiment of the present invention, which differs from the antenna device A2 for the second embodiment as described earlier with reference to FIG. 3 in the following points. In the second embodiment of FIG. 3, although the input/output terminal 6*e* is disposed between the first base member 81 and the second base member 82, such input/output terminal 6*e* in the fifth embodiment of FIG. 7 is disposed between the dielectric substrate 12 and the first base member 81. More specifically, in the antenna device A5 of FIG. 7, in the side face of the circular convex portion 81*a* of the first base member 81, a bore 81*f* is formed in a position confronting the concave groove 12*c* of the dielectric substrate 12. The input/output terminal 6*e* is led outside extending through the bore 81*f* and the porcelain insulator 81*b* provided in the concave groove 12*c* of the dielectric substrate 12.

Since other construction and functions of the antenna device A5 for the fifth embodiment as described above are generally similar to those of the antenna device A2 for the second embodiment described earlier with reference to FIG. 3, detailed description thereof has been abbreviated here for brevity of explanation, with like parts being designated by like reference numerals.

(6) Sixth Embodiment

Figure 8:
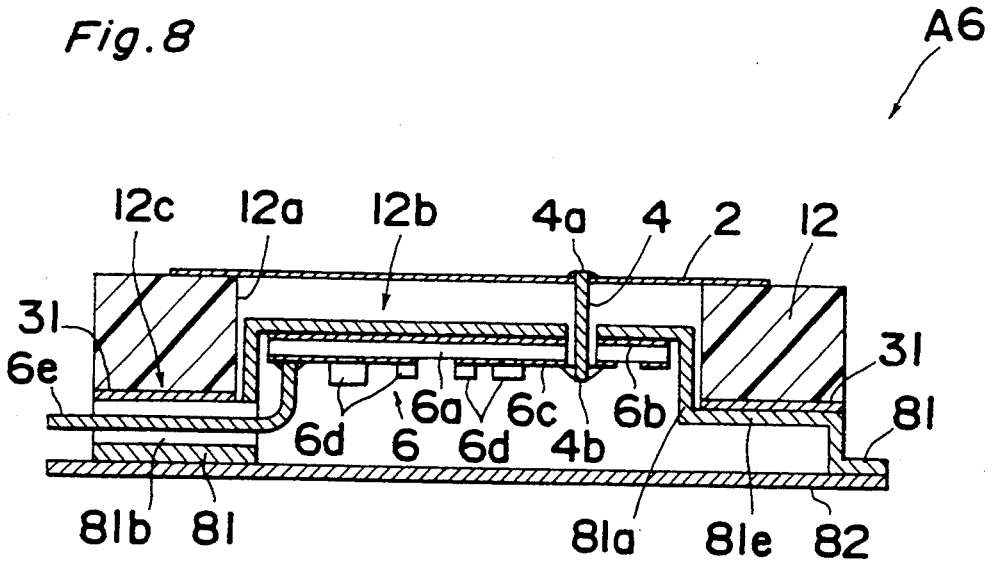
FIG. 8 is a side sectional view showing construction of an antenna device A6 according to a sixth embodiment of the present invention.

FIG. 8 shows an antenna device A6 according to a sixth embodiment of the present invention.

In this sixth embodiment, the construction at the lead-out portion of the input/output terminal 6*e* in the third embodiment of FIG. 4 has been replaced by that of the fifth embodiment as described above with reference to FIG. 7.

In the antenna device A6 for the sixth embodiment of FIG. 8, like parts in the third embodiment of FIG. 4 or the fifth embodiment of FIG. 7 are designated by like reference numerals, with detailed description thereof being abbreviated for brevity of explanation.

(7) Seventh Embodiment

Figure 9:
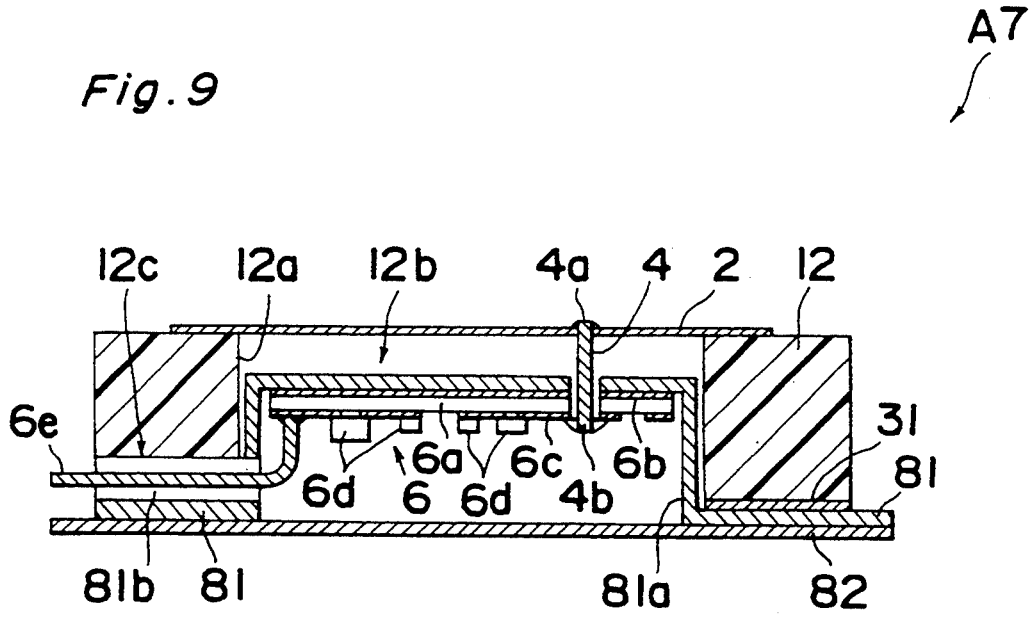
FIG. 9 is a side sectional view showing construction of an antenna device A7 according to a seventh embodiment of the present invention.

Shown in FIG. 9 is an antenna device A7 according to a seventh embodiment of the present invention, which is so arranged that the ground electrode 31 is eliminated from the portion of the concave groove 12*c* of the dielectric substrate 12 in the antenna device A5 for the fifth embodiment of FIG. 7.

Since other constructions and functions of the antenna device A7 for the seventh embodiment as described above are generally similar to those of the antenna device A5 for the fifth embodiment described earlier with reference to FIG. 7, detailed description thereof has been abbreviated here for brevity of explanation, with like parts being designated by like reference numerals.

(8) Eighth Embodiment

Figure 10:
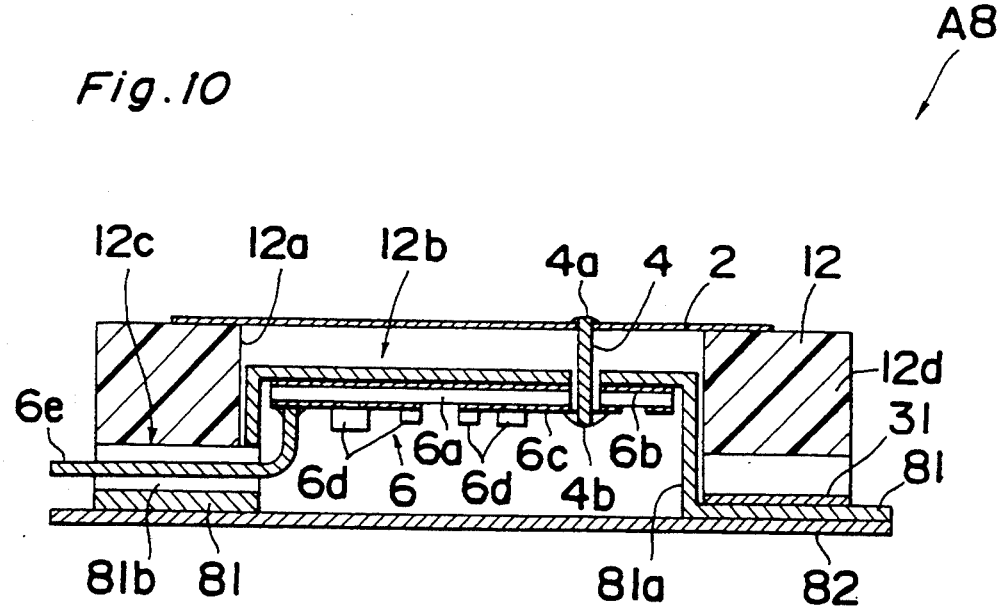
FIG. 10 is a side sectional view showing construction of an antenna device A8 according to an eighth embodiment of the present invention.

Referring further to FIG. 10, there is shown an antenna device A8 for an eighth embodiment according to the present invention, in which, in the seventh embodiment of FIG. 9, there is also formed another concave groove 12*d* in a position confronting the concave groove 12*c* through 180° in the other main surface of the dielectric substrate 12.

Since other constructions and functions of the antenna device A8 for the eighth embodiment as described above are generally similar to those of the antenna device A7 for the seventh embodiment, detailed description thereof has been abbreviated here for brevity of explanation, with like parts being designated by like reference numerals.

(9) Ninth Embodiment

Figure 11:
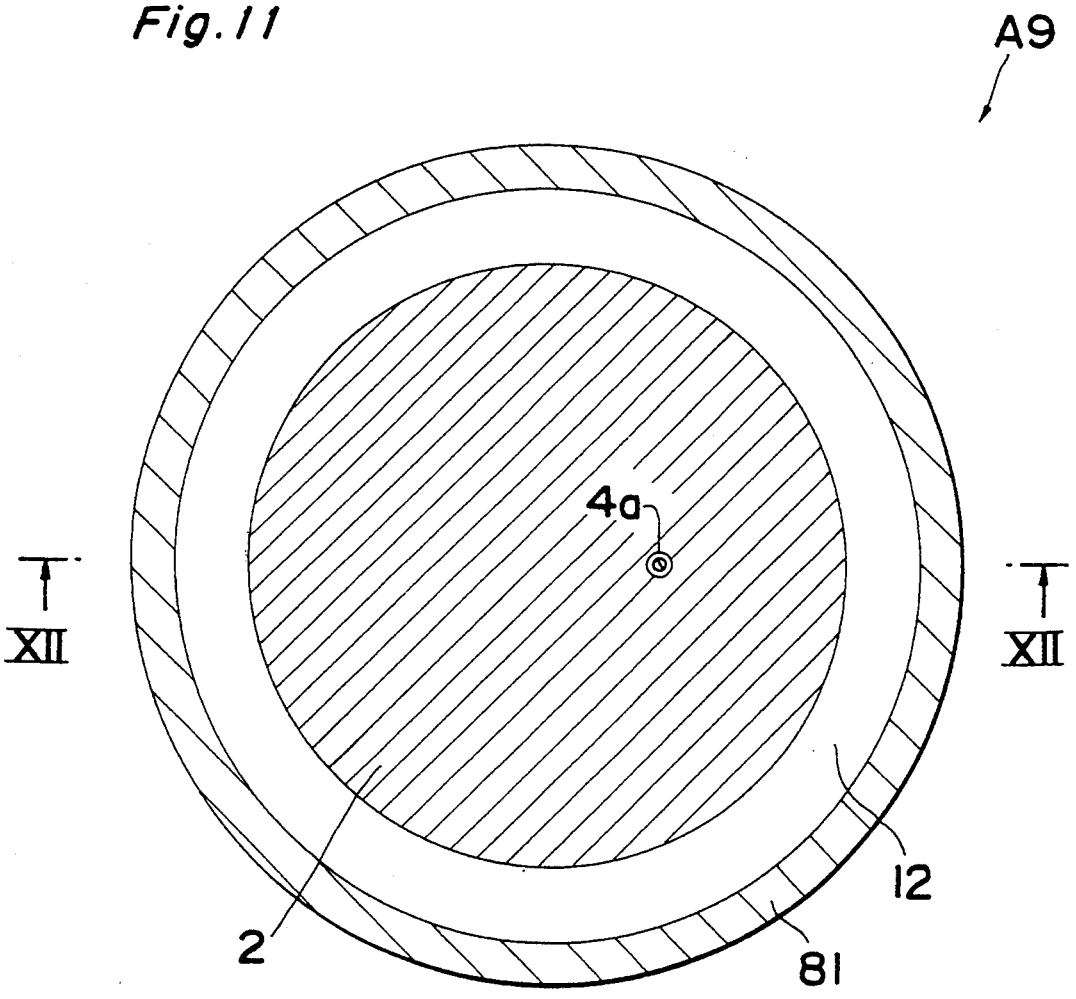
FIG. 11 is a top plan view showing construction of an antenna device A9 according to a ninth embodiment of the present invention.
Figure 12:
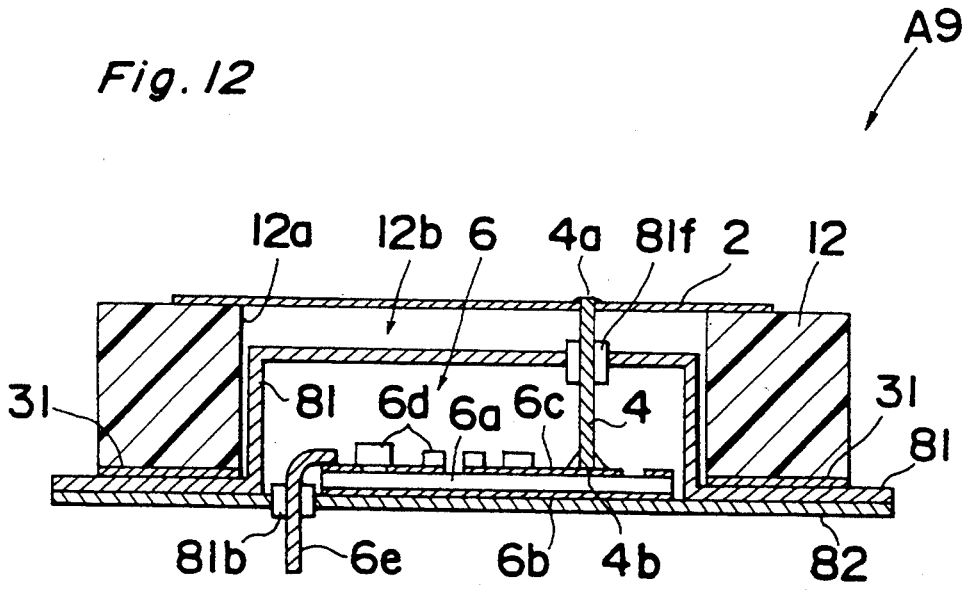
FIG. 12 is a cross sectional view taken along the line XII—XII in FIG. 11.

FIGS. 11 and 12 show construction of an antenna device A9 for a ninth embodiment according to the present invention.

As compared with the antenna device A1 of the first embodiment according to the present invention in FIGS. 1 and 2, it is so modified in the antenna device A9 for the ninth embodiment, that the electronic circuit 6 is fixedly provided on the second base member 82, and the input/output terminal 6*e* is led downwardly out of the device through the porcelain insulator 81*b* provided in the second base member 82, while the feeder line 4 extends through the porcelain guide 81*f* provided in the first base member 81, and connects the radiation electrode 2 with the electronic circuit 6.

Since other constructions and functions of the antenna device A9 for the ninth embodiment as described above are generally similar to those of the antenna device A1 for the first embodiment described earlier with reference to FIGS. 1 and 2, detailed description thereof has been abbreviated here for brevity of explanation, with like parts being designated by like reference numerals.

(10) Tenth Embodiment

Figure 13:
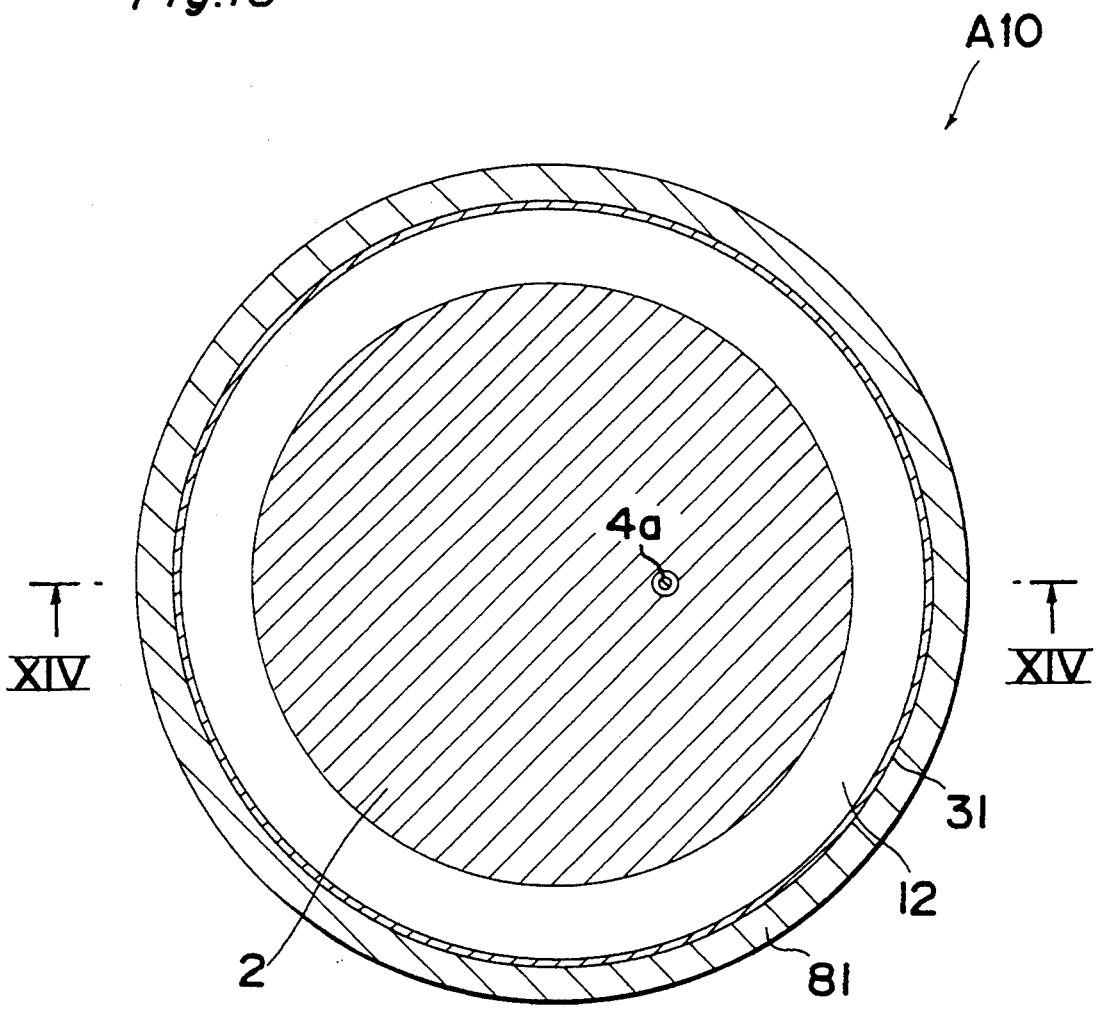
FIG. 13 is a top plan view showing construction of an antenna device A10 according to a tenth embodiment of the present invention.
Figure 14:
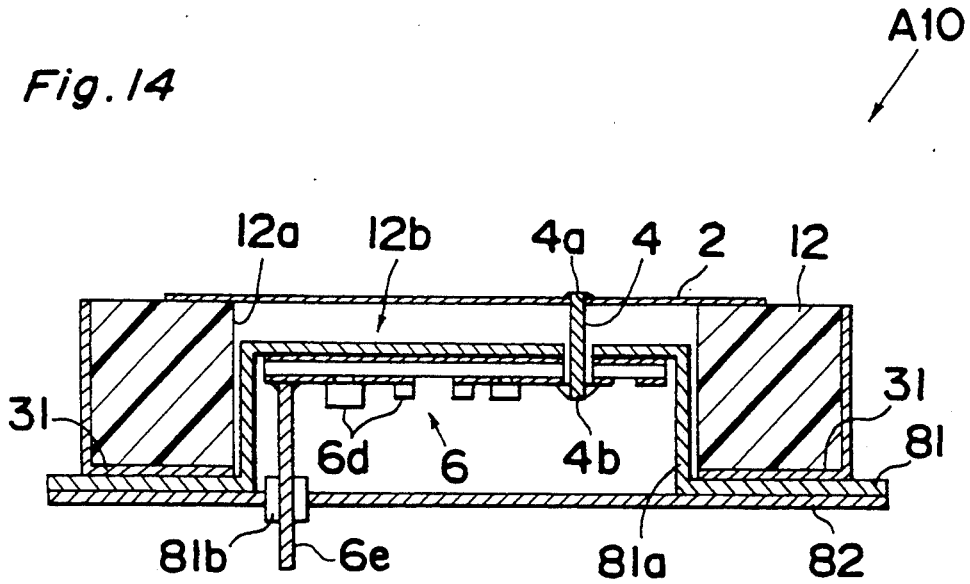
FIG. 14 is a cross sectional view taken along the line XIV—XIV in FIG. 13.

FIGS. 13 and 14 show construction of an antenna device A10 according to a tenth embodiment of the present invention.

As compared with the antenna device A1 for the first embodiment of FIGS. 1 and 2, the ground electrode is also formed on the outer peripheral side face of the dielectric substrate 12 as well as on the other main surface of the dielectric substrate 12 in the tenth embodiment of FIGS. 13 and 14.

Since other constructions and functions of the antenna device A10 for the tenth embodiment as described above are generally similar to those of the antenna device A1 for the first embodiment described earlier with reference to FIGS. 1 and 2, detailed description thereof has been abbreviated here for brevity of explanation, with like parts being designated by like reference numerals.

(11) Eleventh Embodiment

Figure 15:
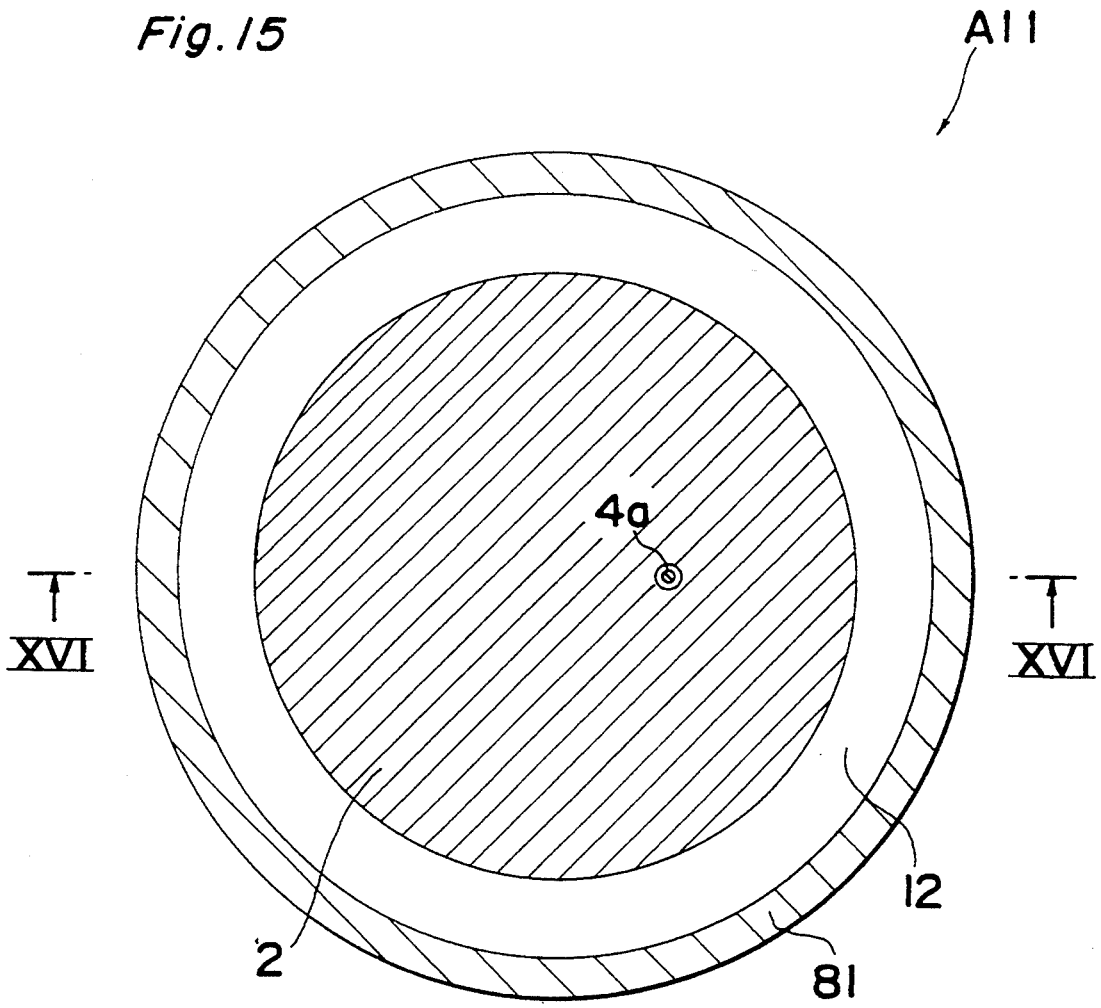
FIG. 15 is a top plan view showing construction of an antenna device A11 according to an eleventh embodiment of the present invention.
Figure 16:
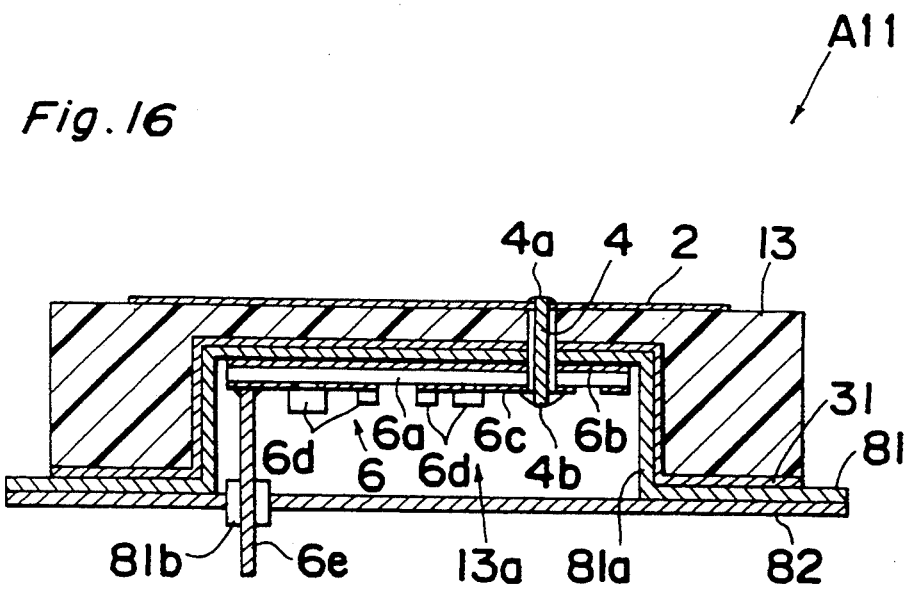
FIG. 16 is a cross sectional view taken along the line XVI—XVI in FIG. 15.

FIGS. 15 and 16 show an antenna device A11 for an eleventh embodiment according to the present invention. In this eleventh embodiment, the circular ring-shape dielectric substrate 12 described as employed in the first to tenth embodiments has been replaced by a circular flat plate-like dielectric substrate 13. At a central portion in the other main surface of said dielectric member 13, a circular concave portion 13*a* is formed so as to serve as a vacant space for accommodating the electronic circuit 6 therein. More specifically, the circular convex portion 81*a* of the first base member 81 fits in the above circular concave portion 13*a*, and the electronic circuit 6 is secured to the ceiling portion of said circular convex portion 81*a*. In this embodiment, the ground electrode 31 is formed over the entire surface of the other main surface of the dielectric substrate 13 and the circular concave portion 13*a* as illustrated.

Since other constructions and functions of the antenna device A11 for the eleventh embodiment as described above are generally similar to those of the antenna device A1 for the first embodiment described earlier with reference to FIGS. 1 and 2, detailed description thereof has been abbreviated here for brevity of explanation, with like parts being designated by like reference numerals.

(12) Twelfth Embodiment

Figure 17:
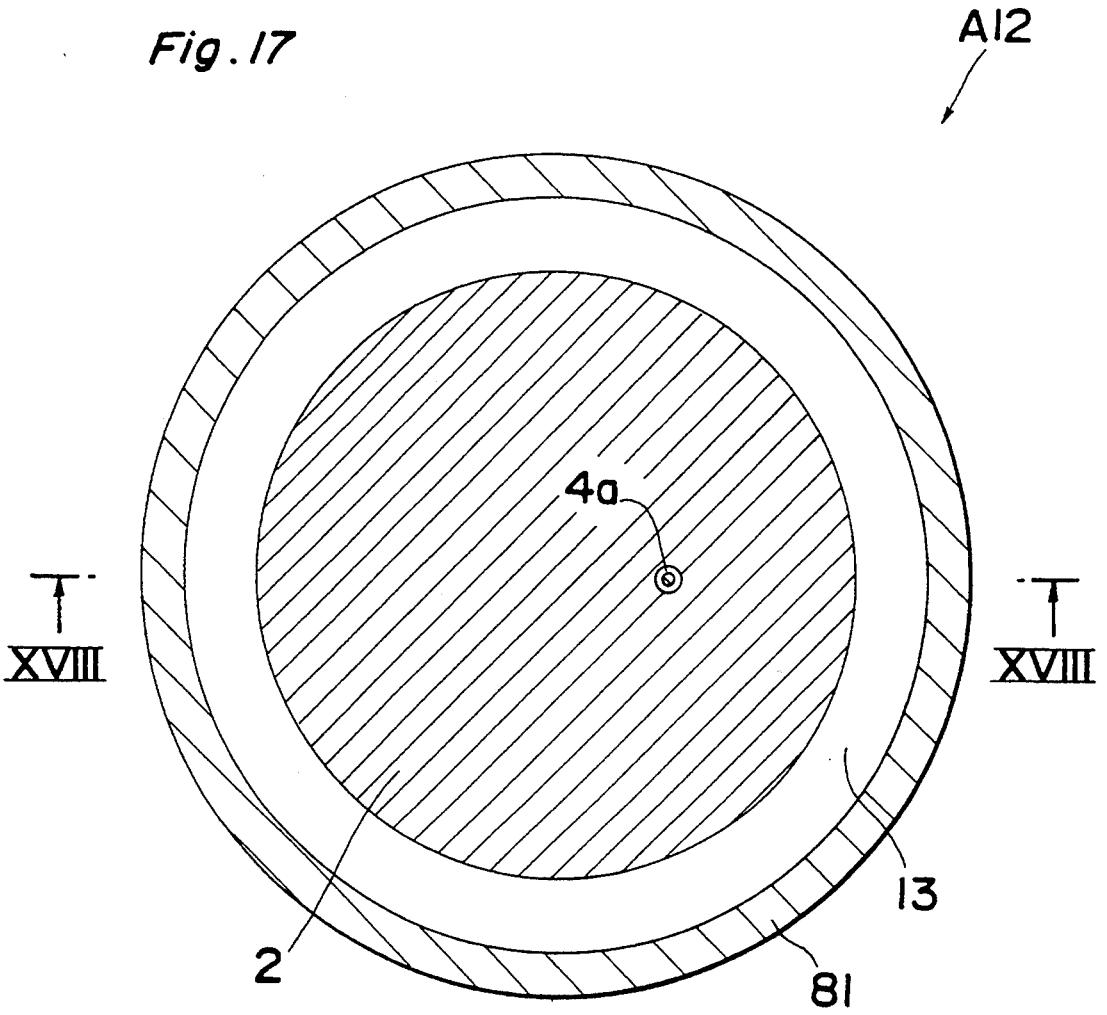
FIG. 17 is a top plan view showing construction of an antenna device A12 according to a twelfth embodiment of the present invention.
Figure 18:
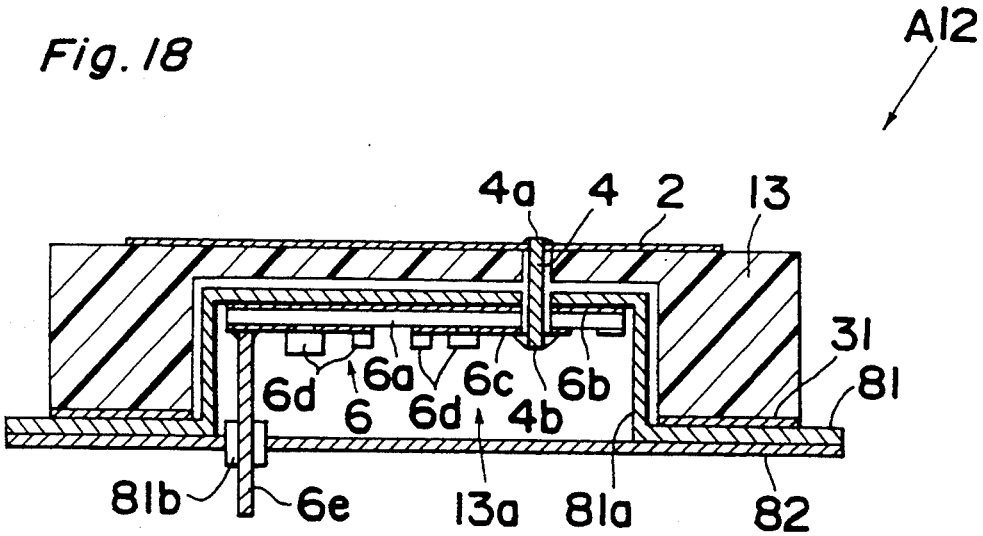
FIG. 18 is a cross sectional view taken along the line XVIII—XVIII in FIG. 17.

FIGS. 17 and 18 show an antenna device A12 for a twelfth embodiment according to the present invention.

In the twelfth embodiment of FIGS. 17 and 18, it is so modified that the ground electrode 31 described as formed on the other main surface of the dielectric substrate 13 and over the entire surface of the circular concave portion 13*a* in the eleventh embodiment of FIGS. 15 and 16 is formed only on the other main surface of the dielectric substrate 13, without formation thereof on the circular concave portion 13*a*.

Since other constructions and functions of the antenna device A12 for the twelfth embodiment as described above are generally similar to those of the antenna device A11 for the eleventh embodiment described earlier with reference to FIGS. 15 and 16, detailed description thereof has been abbreviated here for brevity of explanation, with like parts being designated by like reference numerals.

Although the foregoing description relates to the case where the present invention is applied to antennas for transmission, it is needless to say that the concept of the present invention is also applied to an antenna for reception or antenna which may be commonly used for transmission and reception.

As is clear from the foregoing description, according to the present invention, since it is so arranged to accommodate the electronic circuit within a vacant space provided at the central portion of the dielectric substrate, an antenna device compact and thin in size can be advantageously provided through simple construction at low cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An antenna device which includes a microstrip antenna and an electronic circuit connected to said microstrip antenna, said microstrip antenna comprising:

a circular, ring-shaped dielectric substrate having first and second main surfaces, an outer peripheral face, and an inner peripheral face, and formed with a vacant space portion defined by said inner peripheral face at a central portion of said dielectric substrate;

a radiation electrode formed on said first main surface of said dielectric substrate so as to extend over at least said vacant space portion;

a ground electrode formed at least on the second main surface of said dielectric substrate; and a feeder line for connecting said radiation electrode and said electronic circuit, wherein said radiation electrode has a circular shape with a diameter larger than an inner diameter of said dielectric substrate defined by the inner peripheral face thereof, thereby covering an entire circular opening on said first main surface, with part of an under surface of said radiation electrode contacting said first main surface of said dielectric substrate, said dielectric substrate being fixedly mounted on a first circular base member formed with a circular hollow convex portion which is fitted into said vacant space portion, said electronic circuit being fixed within said convex portion, with a second base member being further fixed on an under surface of said first base member, said electronic circuit being connected to external circuits through an input/output terminal.

2. An antenna device as claimed in claim 1, wherein said input/output terminal is connected at its one end to a circuit pattern of said electronic circuit, and is led out of the antenna device downwardly at its other end, through an insulator provided in the second base member.

3. An antenna device as claimed in claim 1, wherein said input/output terminal is connected at its one end to a circuit pattern of said electronic circuit, and is led out of the antenna device laterally at its other end, through an insulator provided in a groove means defined by a concave groove extending through the second main surface side of said dielectric substrate in a radial direction, and a hollow convex groove formed in said first base member, and fitted into said concave groove.

4. An antenna device as claimed in claim 1, wherein said input/output terminal is connected at its one end to a circuit pattern of said electronic circuit, and is led out of the antenna device laterally at its other end, through an insulator provided in a stepped portion formed in the first base member in a position confronting the second main surface of said dielectric substrate.

5. An antenna device as claimed in claim 1, wherein said dielectric substrate is formed at its second main surface, with two concave grooves in positions confronting each other through 180°, and said first base member is also formed with two convex grooves for fitting with said concave grooves in positions corresponding thereto, said input/output terminal being connected at its one end to a circuit pattern of said electronic circuit, and led out of the antenna device laterally at its other end, through an insulator provided in said convex groove.

6. An antenna device as claimed in claim 1, wherein said input/output terminal is connected at its one end to a circuit pattern of said electronic circuit, and is led out of the antenna device laterally at its other end, through an opening formed in a side wall of the circular convex portion of the first base member, a concave groove formed in the dielectric substrate in a position confronting said opening, and an insulator provided in said concave groove.

7. An antenna device as claimed in claim 1, wherein said input/output terminal is connected at its one end to a circuit pattern of said electronic circuit, and is led out of the antenna device laterally at its other end, through an opening formed in a side wall of the circular convex portion of the first base member formed with a stepped portion, a concave groove formed in the dielectric substrate in a position confronting said opening, and an insulator provided in said concave groove.

8. An antenna device as claimed in claim 1, wherein said input/output terminal is connected at its one end to a circuit pattern of said electronic circuit, and is led out of the antenna device laterally at its other end, through an opening formed in a side wall of the circular convex portion of the first base member, a concave groove formed in the dielectric substrate in a position confronting said opening with said ground electrode being removed at a portion for said concave groove and an insulator provided in said concave groove.

9. An antenna device as claimed in claim 1, wherein said input/output terminal is connected at its one end to a circuit pattern of said electronic circuit, and is led out of the antenna device laterally at its other end, through an opening formed in a side wall of the circular convex portion of the first base member, a first concave groove formed in the dielectric substrate in a position confronting said opening with said ground electrode being removed at a portion for said first concave groove, and an insulator provided in said first concave groove, said dielectric substrate being also formed with another concave groove in a position confronting said first concave groove through 180°, with said ground electrode being also removed at a portion for said another concave groove.

10. An antenna device as claimed in claim 1, wherein said input/output terminal is connected at its one end to a circuit pattern of said electronic circuit, and is led out of the antenna device downwardly at its other end, through an insulator provided in the second base member, said electronic circuit being fixedly mounted on said second base member within said circular hollow convex portion of said first base member.

11. An antenna device as claimed in claim 1, wherein said input/output terminal is connected at its one end to a circuit pattern of said electronic circuit, and is led out of the antenna device downwardly at its other end, through a porcelain insulator provided in the second base member, said ground electrode formed on said second main surface being further provided on an outer peripheral side surface of said dielectric substrate.

12. An antenna device which includes a microstrip antenna and an electronic circuit connected to said microstrip antenna, said microstrip antenna comprising:

a dielectric substrate having first and second main surfaces, an outer peripheral face, and an inner peripheral face, and formed with a vacant space portion defined by said inner peripheral face at a central portion of said dielectric substrate;

a radiation electrode formed on said first main surface of said dielectric substrate so as to extend over at least said vacant space portion;

a ground electrode formed at least on the second main surface of said dielectric substrate; and a feeder line for connecting said radiation electrode and said electronic circuit, wherein said dielectric substrate has a circular flat plate shape closed on its first main surface, said radiation electrode having a circular shape with a diameter larger than an inner diameter of said dielectric substrate defined by the inner peripheral face thereof with, an under surface of said radiation electrode contacting said first main surface of said dielectric substrate, said dielectric substrate being fixedly mounted on a first circular base member formed with a circular hollow convex portion which is fitted into said vacant space portion, said electronic circuit being fixed at a ceiling portion thereof to an under surface of said base member, with a second base member being further fixed on an under surface of said first base member.

13. An antenna device as claimed in claim 12, wherein an input/output terminal is connected at its one end to a circuit pattern of said electronic circuit, and is led out of the antenna device downwardly at its other end, through an insulator provided in the second base member, said ground electrode formed on said second main surface of said dielectric substrate being further formed over an entire inner surface of said inner peripheral face.

14. An antenna device as claimed in claim 12, wherein an input/output terminal is connected at its one end to a circuit pattern of said electronic circuit, and is led out of the antenna device downwardly at its other end, through an insulator provided in the second base member, said ground electrode being formed only on said second main surface of said dielectric substrate.

* * * * *